US009549644B2

(12) United States Patent
McLeod

(10) Patent No.: US 9,549,644 B2
(45) Date of Patent: Jan. 24, 2017

(54) ADJUSTABLE SHOWER CURTAIN

(71) Applicant: Norman McLeod, Mount Pleasant, SC (US)

(72) Inventor: Norman McLeod, Mount Pleasant, SC (US)

( * ) Notice: Subject to any disclaimer, the term of this patent is extended or adjusted under 35 U.S.C. 154(b) by 2 days.

(21) Appl. No.: 14/204,828

(22) Filed: Mar. 11, 2014

(65) Prior Publication Data

US 2015/0257610 A1 Sep. 17, 2015

(51) Int. Cl.
*A47K 3/38* (2006.01)

(52) U.S. Cl.
CPC ..... *A47K 3/38* (2013.01); *Y10T 29/49826* (2015.01)

(58) Field of Classification Search
CPC ..... A47K 3/38
USPC ..... 4/558
See application file for complete search history.

(56) References Cited

U.S. PATENT DOCUMENTS 3,629,875 A * 12/1971 Dow ..... A47K 3/325 135/902
5,901,769 A * 5/1999 Farley ..... 160/123
6,845,525 B2 * 1/2005 Bathurst ..... 4/608
2008/0289095 A1 * 11/2008 Li ..... 4/610

* cited by examiner

*Primary Examiner* — Janie Loeppke
(74) *Attorney, Agent, or Firm* — Moore & Van Allen PLLC; Patrick B. Horne

(57) ABSTRACT

The present invention provides an adjustable shower curtain. In one embodiment, the apparatus for modifying a substantially planar profile of a bathtub curtain in a bathing enclosure space comprises a shower curtain, wherein the shower curtain comprises a top side, a bottom side, a left lateral side, a right lateral side, a length, and a width, wherein a surface defined by the top side, the bottom side, the left lateral side, and the right lateral side is positionable in a substantially planar profile; an adjustable portion operatively coupled to the shower curtain enabling a user to modify the substantially planar profile of the shower curtain surface, wherein the shower curtain surface is configured to substantially conform to the contour of the adjustable portion.

20 Claims, 5 Drawing Sheets

ADJUSTABLE SHOWER CURTAIN

BACKGROUND OF THE INVENTION

Field of the Invention

The present disclosure is directed to a shower curtain for a shower enclosure.

Description of Related Art

There is a need for a shower curtain to form a shower enclosure with a bathtub or another shower base capable of being fitted with existing installation and provide additional bathing space to the resident when needed.

BRIEF SUMMARY

According to some embodiments, a shower curtain for adjusting an enclosure space defined by a bathtub and the shower curtain is presented, the shower curtain comprising: a top side, a bottom side, a left lateral side, a right lateral side, a length, and a width, wherein a surface formed by the top side, the bottom side, the left lateral side, and the right lateral side is positionable to have a substantially planar profile; and an adjustable portion operatively coupled to the shower curtain, wherein the adjustable portion enables a user to modify the substantially planar profile of the shower curtain such that the enclosure space may be increased or decreased.

In some embodiments, the shower curtain further comprises: an interior portion, wherein the interior portion comprises an interior top side, an interior bottom side, an interior left lateral side, an interior right lateral side, an interior length, an interior width, and an interior diagonal, wherein the interior length defined by the interior portion is less than the length defined by the shower curtain and the interior width defined by the interior portion is lesser than the width defined by the shower curtain.

In some embodiments, the adjustable portion is operatively coupled to the interior portion; wherein the adjustable portion is positioned along at least one of the interior length, the interior width, and the interior diagonal; and wherein the adjustable portion provides a substantially curved shape to the interior portion.

In some embodiments, the shower curtain further comprises: a securing member, wherein the securing member is positioned along the length of the shower curtain in close proximity to the top side defined by the shower curtain, wherein the securing member is capable of being operatively coupled to a curtain rod.

In some embodiments, the shower curtain further comprises: a securing member capable of being operatively coupled to a curtain rod; and an attachment member, wherein the attachment member is operatively coupled to the shower curtain in close proximity to the bottom side defined by the shower curtain to secure the shower curtain to the bathtub shower.

In some embodiments, the adjustable portion is inflatable.

In some embodiments, the adjustable portion is constructed using one or more flexible ribs.

In some embodiments, the adjustable portion is constructed by molding one or more substantially flexible ribs to form a single frame.

In some embodiments, the adjustable portion is integrally formed with the interior member.

In some embodiments, the adjustable portion is formed on the surface of the interior member.

In some embodiments, the adjustable portion is water impermeable.

In some embodiments, the adjustable portion is operatively coupled to the shower curtain.

In some embodiments, the length and width defined by the shower curtain are dimensioned to at least partially enclose the bathtub shower enclosure.

In some embodiments, the attachment member may be positioned to drape over the inner wall of a bathtub.

In one aspect, the present invention is directed to an apparatus for modifying a substantially planar profile of a bathtub curtain in a bathing enclosure space, the apparatus comprising: a shower curtain, wherein the shower curtain comprises: a top side, a bottom side, a left lateral side, a right lateral side, a length, and a width, wherein a surface defined by the top side, the bottom side, the left lateral side, and the right lateral side is positionable in a substantially planar profile; an adjustable portion operatively coupled to the shower curtain enabling a user to modify the substantially planar profile of the shower curtain surface, wherein the shower curtain surface is configured to substantially conform to the contour of the adjustable portion.

In some embodiments, the apparatus enables the user to modify the substantially planar profile of the shower curtain surface by applying pressure in an outward direction relative to the bathing shower enclosure space such that the bathing shower enclosure space may be increased.

In some embodiments, the apparatus enables the user to modify the substantially planar profile of the shower curtain surface by applying pressure in an inward direction relative to the bathing shower enclosure space such that the bathing shower enclosure space may be decreased.

In some embodiments, the apparatus comprises a handle operatively coupled to the shower curtain to enable the user to modify the substantially planar profile of the shower curtain surface.

In another aspect, the present invention is directed to a shower curtain for adjusting an enclosure space defined by a bathtub and the shower curtain, the shower curtain comprising: a top side, a bottom side, a left lateral side, a right lateral side, a length, and a width, wherein a surface defined by the top side, the bottom side, the left lateral side, and the right lateral side is positionable to have a standard configuration, wherein the standard configuration comprises the shower curtain surface having a substantially planar profile; and an adjustable portion operatively coupled to the shower curtain, wherein the adjustable portion enables a user to modify the surface of the shower curtain from the standard configuration to a first configuration or a second configuration; wherein the first configuration comprises the shower curtain surface having at least a partially concave surface relative to the substantial planar profile of the surface in the standard configuration and the enclosure space such that the enclosure space is increased when the user modifies the surface from the standard configuration to the first configuration; and wherein the second configuration comprises the shower curtain surface having at least a partially convex surface relative to the substantial planar profile of the surface in the standard configuration and the bathing shower enclosure space such that the bathing shower enclosure space is decreased when the user modifies the surface from the standard configuration to the second configuration.

In some embodiments, the shower curtain comprises a handle operatively coupled to the shower curtain to enable the user to change the shower curtain surface configuration from the standard configuration to the first configuration or the second configuration.

BRIEF DESCRIPTION OF THE DRAWINGS

The foregoing and other advantages and features of the invention, and the manner in which the same are accomplished, will become more readily apparent upon consideration of the following detail description of the invention taken in conjunction with the accompanying drawings, which illustrate preferred and exemplary embodiments and which are not necessarily drawn to scale, wherein.

DETAILED DESCRIPTION OF EMBODIMENTS OF THE INVENTION

The present invention now will be described more fully hereinafter with reference to the accompanying drawings, in which some, but not all embodiments of the invention are shown. This invention may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The present invention is summarized as an adjustable shower curtain capable of being installed in a bathtub or another bath enclosure with an existing curtain rod structure. The present invention relates generally to bathtub shower enclosures, and more particularly to an adjustable shower curtain. In the construction of most bathrooms, a shower nozzle is typically mounted on the wall in an enclosure above a bath tub to provide the option of a shower for a resident using the bathroom facility. In defining such enclosures, a shower curtain is used to prevent water from flooding or splashing outside the shower area. A shower curtain is ordinarily constructed and arranged to drape loosely from a curtain rod to prevent water from splashing out of the enclosure. The shower curtain is draped in the bath tub below so that the water is not splashed out of the bathtub. Typically, conventional shower curtain rods are known to have a linear structure. However, it is not uncommon to use a shower curtain rod comprising a central portion curving to create additional bathing space for the resident and prevent the sensation of being cramped. Typically, the shower curtain rod includes two end portions with angled fasteners to enable the shower curtain rod to be operatively coupled between a pair of parallel walls at a bath tub enclosure. In such installations, the center of the relatively heavy shower rod (with a shower curtain) may cause the shower rod to rotate downward, putting significant stress on the fasteners at each end.

Figure 1:
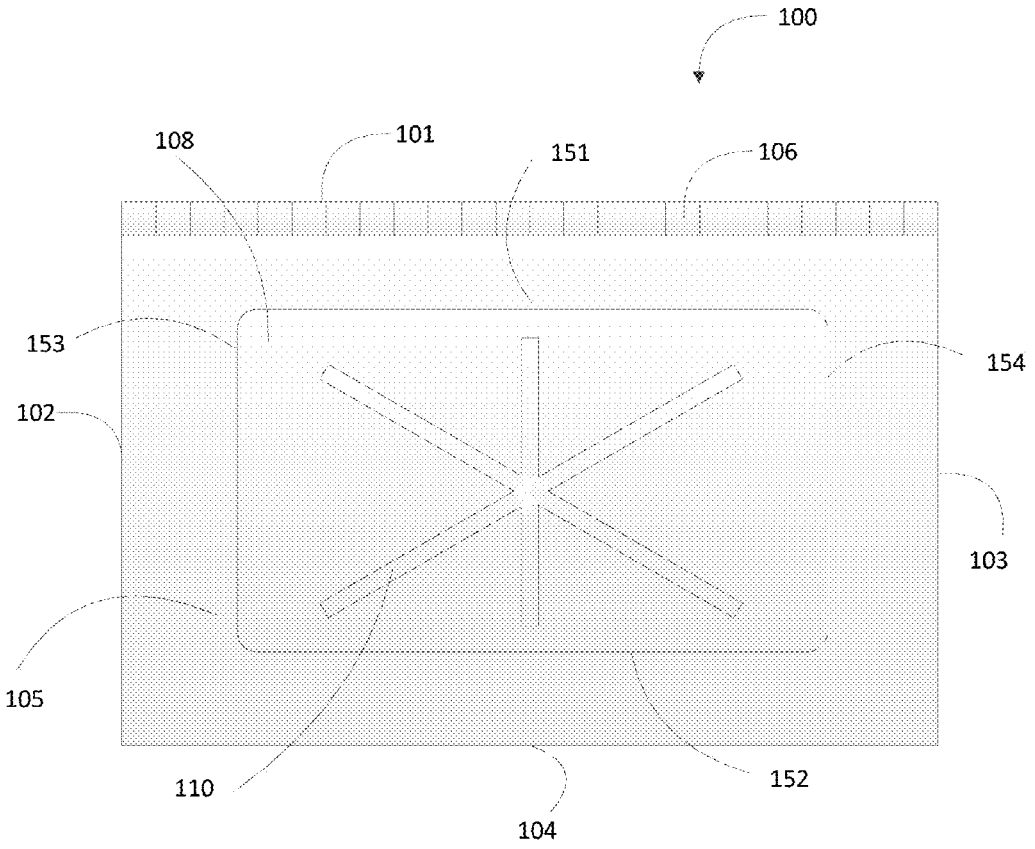
FIG. 1 illustrates a front view of a shower curtain.
Figure 2A:
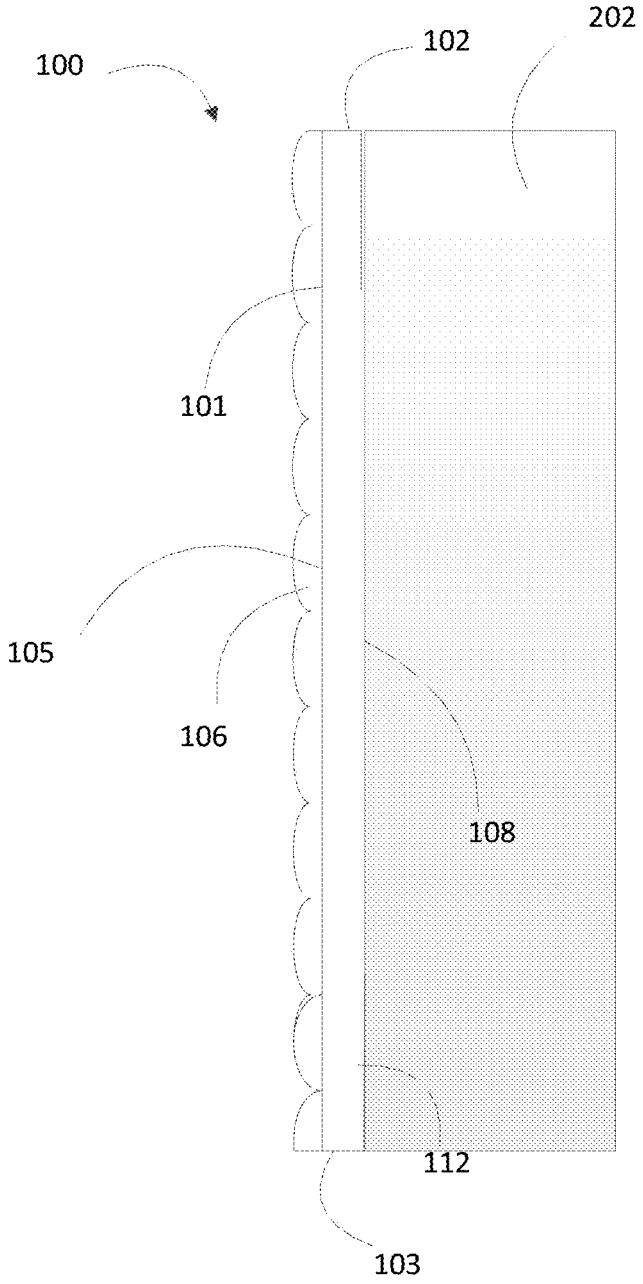
FIGS. 2A, 2B, and 2C illustrate a top view of the shower curtain of FIG. 1.
Figure 2B:
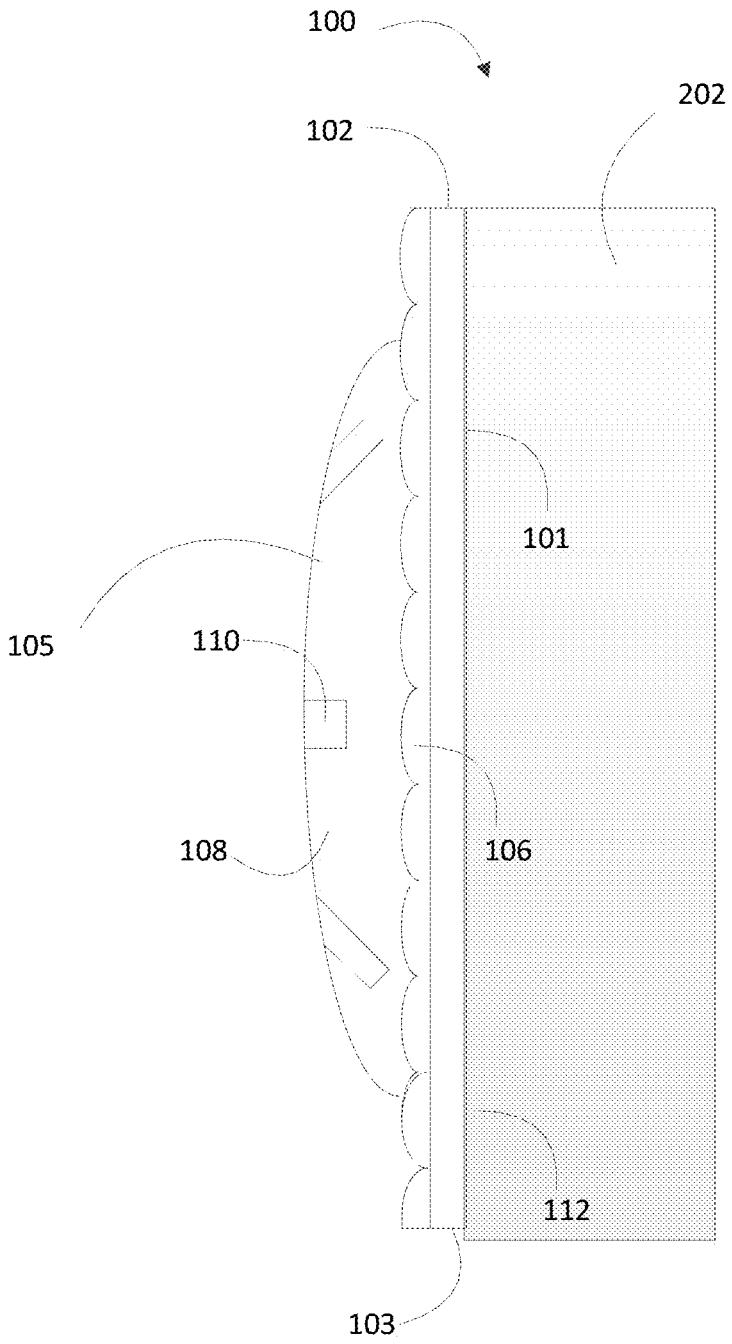
Figure 2C:
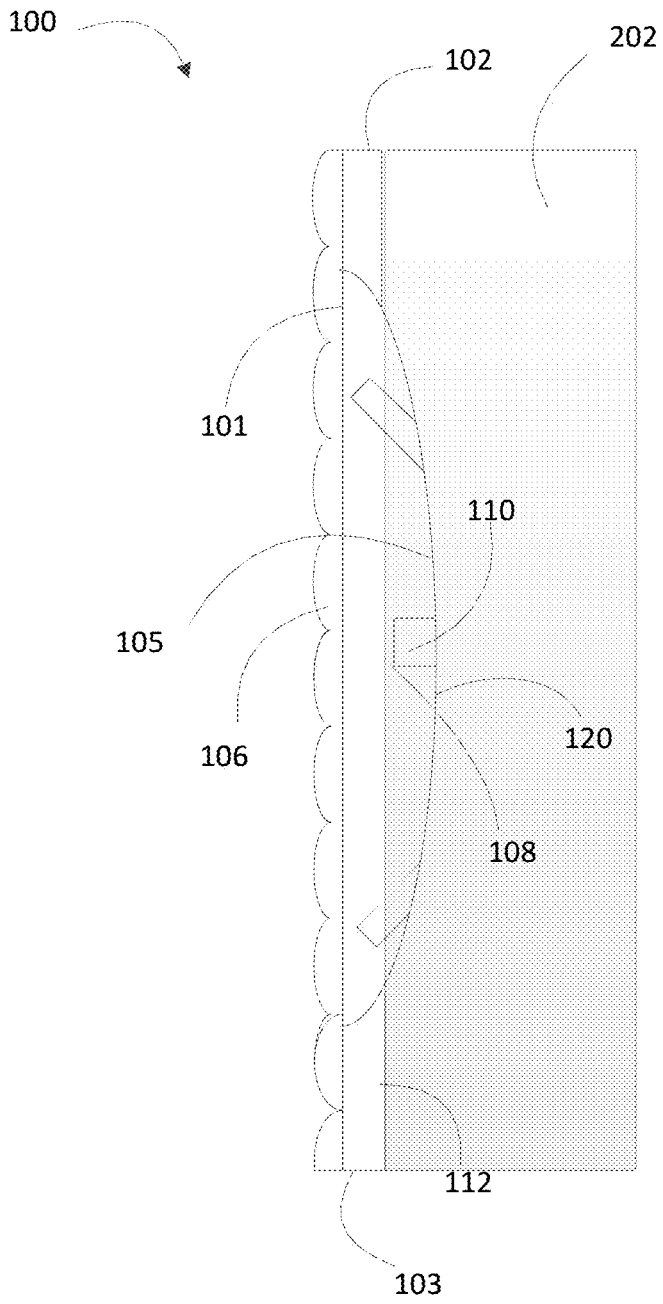
Figure 3:
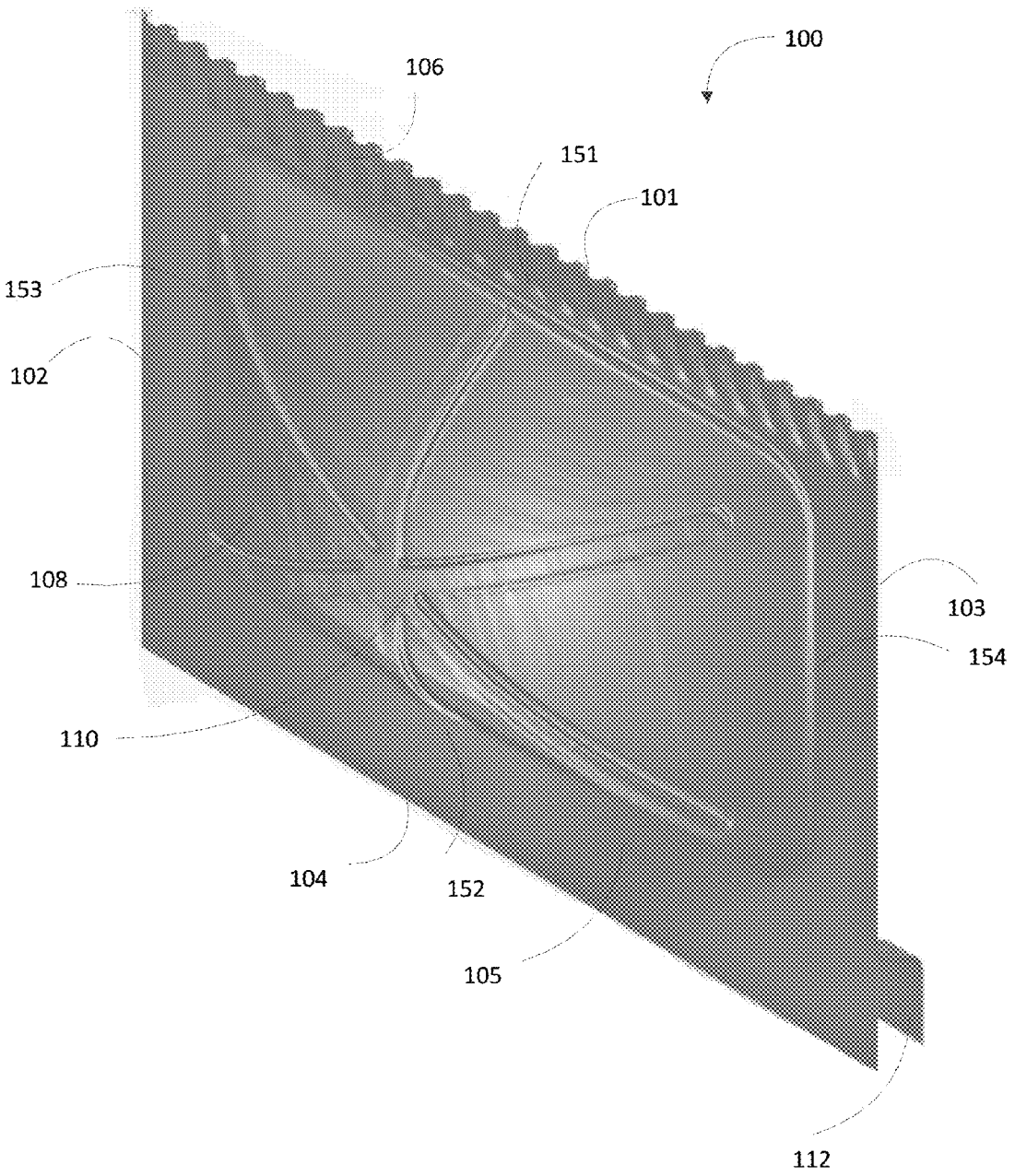
FIG. 3 illustrates a perspective view of the shower curtain of FIG. 1.

FIGS. 1 through 3 illustrate an adjustable shower curtain 100, according to one embodiment of the present invention. The adjustable shower curtain 100 may have a rectangular shape, although its overall shape can be made to vary. The adjustable shower curtain 100 typically has four sides, defined for the purposes of the document as a top side 101, a left lateral side 102, a right lateral side 103, and a bottom side 104. The shower curtain 100 has a width defined as the distance between the top side 101 and bottom side 104, a length defined as the distance between the left lateral side 102 and the right lateral side 103, a diagonal defined by the length and the width of the adjustable shower curtain 100, and a surface 105 defined by the top side, the bottom side, the left lateral side, and the right lateral side. The length and width of the adjustable shower curtain 100 may be defined to at least partially cover the enclosure and prevent the water from flooding or splashing out of the bathtub.

In some embodiments, the adjustable shower curtain 100 comprises a securing member 106 positioned along the length of the adjustable shower curtain 100 in close proximity to the top side 101 of the adjustable shower curtain 100. In one aspect, the securing member 106 may be operatively coupled to a curtain rod (not shown) to allow the adjustable shower curtain 100 to be positioned along the rod. In some embodiments, the securing member 106 of the adjustable shower curtain 100 may be reinforced with one or more layers of vinyl, plastic, or the like. The securing member 106 may define means to enable the adjustable shower curtain 100 to be operatively coupled to a curtain rod. In one aspect, the securing member 106 may include a hollow portion along the length of the top side 101 to enable the curtain rod to be inserted along the hollow portion and be operatively coupled between a pair of parallel walls in the bath tub enclosure. In another aspect, the adjustable shower curtain 100 is operatively coupled to the curtain rod using one or more fastening members such as a hook, a ring, a clamp or the like, by inserting the one or more fastening members through one or more holes positioned on the securing member along the length of the adjustable shower curtain 100.

In some embodiments, the adjustable shower curtain 100 comprises an interior portion 108. The interior portion 108 may have a rectangular shape, although its overall shape can be made to vary widely. The interior portion 108 has four sides defined for the purposes of this document as an interior top side 151, an interior bottom side 152, an interior left lateral side 153, and an interior right lateral side 154. Further, the interior portion 108 defines an interior length as a distance between the interior left later side 153 and the interior right lateral side 154, a width defined as a distance between the interior top side 151 and interior bottom side 154, and an interior diagonal length defined by the interior length and interior width. In some embodiments, the adjustable shower curtain may not comprise an interior portion 108.

In some embodiments, the adjustable shower curtain 100 includes an adjustable portion 110. In some embodiments, the adjustable portion 110 provides the substantially curved shape of the adjustable shower curtain 100. In one aspect, the adjustable portion 110 may be operatively coupled to the interior portion 108 extending substantially along the interior length, interior width, and/or the interior diagonal defined by the interior portion 108 of the adjustable shower curtain 100. In another aspect, the adjustable portion 110 may be operatively coupled to the surface 105 of the adjustable shower curtain 100. In some embodiments, the adjustable portion 110 may comprise one or more individual ribs positioned separately from each other. In some other embodiments, the adjustable portion 110 may be molded to form a single piece. In some embodiments, the adjustable portion 110 may be integrally formed with the adjustable shower curtain 100. In some other embodiments, the adjustable portion 110 may be formed on the outer surface of the adjustable shower curtain 100. In one aspect, the adjustable portion 110 may be constructed using a substantially flexible frame molded to form a single piece with materials such as polyethylene, polyurethane, rubber, or any material with the property of flexibility and water impermeable. In another aspect, the ribs 110 may be a molded formation integrally formed within the adjustable shower curtain 100 of the shower curtain 100 capable of being inflated to achieve a substantial amount of rigidity while remaining adequately flexible.

In some embodiments, the adjustable portion 110 comprises a first position, wherein the first position is a resting position. In the first position, the adjustable portion 110 is substantially straight relative to a two dimensional plane defined by the adjustable shower curtain 100. Further, the adjustable portion 110 comprises a second position, wherein adjustable portion 110 in the second position defines a concave shape relative to the first position. In addition, the adjustable portion 110 comprises a third position, wherein the adjustable portion 110 in the third position defines a convex position relative to the first position.

FIGS. 2A, 2B, and 2C illustrate a top view of the adjustable shower curtain 100 in accordance with an embodiment of the invention. FIG. 2A illustrates a standard configuration of a shower curtain 100. In one aspect, the standard configuration comprises the shower curtain surface defining a substantially planar profile. The standard configuration is typically the resting position of the adjustable shower curtain 100.

FIG. 2B illustrates a first configuration of the adjustable shower curtain 100 for modifying an enclosure space 202. In one aspect, the adjustable shower curtain 100 includes an adjustable portion 110 operatively coupled to the adjustable shower curtain 100. The adjustable portion 110 may enable the resident to modify the adjustable shower curtain 100 from the standard configuration to a first configuration. In one aspect, the first configuration includes the surface 105 of the adjustable shower curtain 100 having at least a partially concave surface relative to the substantial planar profile of the surface in the standard configuration and the enclosure space such that the enclosure space is increased when the resident modifies the surface from the standard configuration to the first configuration. In another aspect, the adjustable shower curtain 100 may be configured such that the surface 105 of the adjustable shower curtain 100 may substantially conform to the contour of the adjustable portion 110. In some embodiments, the apparatus may enable the resident to modify the shower curtain configuration from a standard configuration to a first configuration by applying pressure in an outward direction relative to the enclosure space 202 such that the enclosure space 202 may be increased.

FIG. 2C illustrates a first configuration of the adjustable shower curtain 100 for modifying an enclosure space 202. In one aspect, the adjustable shower curtain 100 includes an adjustable portion 110 operatively coupled to the adjustable shower curtain 100. The adjustable portion 110 may enable the resident to modify the adjustable shower curtain 100 from the standard configuration to a second configuration. In one aspect, the second configuration includes the surface 105 of the adjustable shower curtain 100 having at least a partially convex surface relative to the substantial planar profile of the surface in the standard configuration and the enclosure space such that the enclosure space is decreased when the resident modifies the surface from the standard configuration to the first configuration. In another aspect, the adjustable shower curtain 100 may be configured such that the surface 105 of the adjustable shower curtain 100 may substantially conform to the contour of the adjustable portion 110. In some embodiments, the apparatus may enable the resident to modify the shower curtain configuration from a standard configuration to a second configuration by applying pressure in an inward direction relative to the enclosure space 202 such that the enclosure space 202 may be decreased.

In some embodiments, the adjustable shower curtain 100 comprises an attachment member 112. The attachment member 112 may be operatively coupled to the adjustable shower curtain 100 in close proximity to the bottom side 104 to enable the adjustable shower curtain 100 to be draped over the inner wall of the bathtub. Typically, the attachment member 112 is used to direct a substantial amount of water splashing from the bathtub area back into the bathtub to eventually be disposed of through a drain positioned within the bathtub. In some embodiments, the attachment member 112 may enable the adjustable shower curtain 100 to remain in place inside the tub by providing a heavier base relative to the body of the adjustable shower curtain 100. In one aspect, the heavier base may be constructed by reinforcing the attachment member 112 with one or more layers of such as vinyl, plastic, or the like. In another aspect, the heavier base may be constructed by placing a magnetized strip on the surface of the attachment member 112. In yet another aspect, the heavier base may be constructed by attaching weights on the surface of the attachment member 112. In some other embodiments, the attachment member 112 may not include a heavier base.

In some embodiments, the adjustable shower curtain 100 may include fasteners such as hook and loop fastener, or the like along the left lateral side 102 and/or the right lateral side 104 to secure the adjustable shower curtain 100 when in use. In one aspect, the interior portion 108 comprises a handle 120 (as shown in FIG. 2C) formed integrally with the shower curtain 100 on either side to enable the resident to apply pressure in an outward or inward direction relative to the bathing space 202, to increase or decrease the bathing space 202 respectively. In some embodiments, the adjustable shower curtain 100 may include one or more pockets on the surface to hold toiletries.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A shower curtain for adjusting an enclosure space defined by a bathtub and the shower curtain, the shower curtain comprising:

a top side, a bottom side, a left lateral side, a right lateral side, a length, and a width, wherein a surface formed by the top side, the bottom side, the left lateral side, and the right lateral side is positionable to have a substantially planar profile; and a non-adjustable portion having a substantially planar profile operatively coupled to the shower curtain;

an interior portion operatively coupled to the shower curtain and comprising an adjustable portion configured to be in a standard configuration when a plurality of ribs are un-inflated and to be in either a concave configuration or a convex configuration when the plurality of ribs are inflated, wherein the interior portion has a substantially planar profile when it is in the standard configuration, wherein the adjustable portion comprises:

the plurality of ribs comprising:

a first diagonal rib disposed substantially along a first diagonal of the adjustable portion; and a second diagonal rib disposed substantially along a second diagonal of the adjustable portion, wherein the first diagonal rib and the second diagonal rib are configured to be inflated to achieve rigidity thereby biasing the adjustable portion to remain in either the concave configuration or the convex configuration and to retain sufficient flexibility to enable the adjustable portion to change from the concave configuration to the convex configuration and from the convex configuration to the concave configuration, wherein the adjustable portion is configured to receive force from a user, thereby causing the shower curtain to change:

(i) from the concave configuration to the convex configuration, thereby increasing the enclosure space; or (ii) from the convex configuration to the concave configuration, thereby decreasing the enclosure space;

wherein the substantially planar profile of the non-adjustable portion and the adjustable portion are on the same plane as the substantially planar profile of the shower curtain in the standard configuration.

2. The apparatus of claim 1, wherein the shower curtain further comprises:

an interior portion, wherein the interior portion comprises an interior top side, an interior bottom side, an interior left lateral side, an interior right lateral side, an interior length, an interior width, and an interior diagonal, wherein the interior length defined by the interior portion is less than the length defined by the shower curtain and the interior width defined by the interior portion is lesser than the width defined by the shower curtain.

3. The apparatus of claim 2, wherein the adjustable portion is operatively coupled to the interior portion;

wherein the adjustable portion is positioned along at least one of the interior length, the interior width, and the interior diagonal; and wherein the adjustable portion provides a substantially curved shape to the interior portion.

4. The apparatus of claim 1, wherein the shower curtain further comprises:

a securing member, wherein the securing member is positioned along the length of the shower curtain in close proximity to the top side defined by the shower curtain, wherein the securing member is capable of being operatively coupled to a curtain rod.

5. The apparatus of claim 1, wherein the shower curtain further comprises:

a securing member capable of being operatively coupled to a curtain rod, wherein the securing member is operatively coupled to the non-adjustable portion of the shower curtain; and an attachment member, wherein the attachment member is operatively coupled to the non-adjustable portion of the shower curtain in close proximity to the bottom side defined by the shower curtain to secure the shower curtain to the bathtub shower.

6. The apparatus of claim 5, wherein the attachment member may be positioned to drape over the inner wall of a bathtub.

7. The apparatus of claim 1, wherein the adjustable portion is constructed by molding one or more substantially flexible ribs to form a single frame.

8. The apparatus of claim 1, wherein the adjustable portion is integrally formed with the interior member.

9. The apparatus of claim 1, wherein the adjustable portion is formed on the surface of the interior member.

10. The apparatus of claim 1, wherein the adjustable portion is water impermeable.

11. The apparatus of claim 1, wherein the length and width defined by the shower curtain are dimensioned to at least partially enclose the bathtub shower enclosure.

12. The shower curtain of claim 1, wherein the plurality of ribs further comprises:

a third rib disposed substantially parallel to a width of the adjustable portion, wherein the third rib is configured to be inflated to achieve rigidity thereby biasing the adjustable portion to remain in either the concave configuration or the convex configuration and to retain sufficient flexibility to enable the adjustable portion to change from the concave configuration to the convex configuration and from the convex configuration to the concave configuration.

13. The shower curtain of claim 1, further comprising:

a handle integrally attached to the adjustable portion, wherein the handle is configured to receive force from the user, thereby causing the shower curtain to change:

(i) from the concave configuration to the convex configuration, thereby increasing the enclosure space; or (ii) from the convex configuration to the concave configuration, thereby decreasing the enclosure space.

14. A shower curtain for adjusting an enclosure space defined by a bathtub and the shower curtain for adjusting an enclosure space defined by the shower curtain, the shower curtain comprising:

a top side, a bottom side, a left lateral side, a right lateral side, a length, and a width, wherein a surface formed by the top side, the bottom side, the left lateral side, and the right lateral side is positionable to have a substantially planar profile; and a non-adjustable portion having a substantially planar profile operatively coupled to the shower curtain;

an interior portion operatively coupled to the shower curtain and comprising an adjustable portion configured to be in a standard configuration when un-inflated and to be in either a concave configuration or a convex configuration when inflated, wherein the interior portion has a substantially planar profile in the standard configuration, wherein the adjustable portion comprises:

a first diagonal rib disposed substantially along a first diagonal of the adjustable portion, wherein the first diagonal rib is configured to be inflated to achieve rigidity thereby biasing the adjustable portion to remain in either the concave configuration or the convex configuration and to retain sufficient flexibility to enable the adjustable portion to change from the concave configuration to the convex configuration and from the convex configuration to the concave configuration, wherein the adjustable portion is configured to receive force from a user, thereby causing the shower curtain to change:

(i) from the concave configuration to the convex configuration, thereby increasing the enclosure space; or (ii) from the convex configuration to the concave configuration, thereby decreasing the enclosure space.

15. The shower curtain of claim 14, wherein the adjustable portion further comprises:

a second rib disposed substantially parallel to a width of the adjustable portion, wherein the second rib is configured to be inflated to achieve rigidity thereby biasing the adjustable portion to remain in either the concave configuration or the convex configuration and to retain sufficient flexibility to enable the adjustable portion to change from the concave configuration to the convex configuration and from the convex configuration to the concave configuration.

16. The shower curtain of claim 14, further comprising:

a handle integrally attached to the adjustable portion, wherein the handle is configured to receive force from the user, thereby causing the shower curtain to change:

(i) from the concave configuration to the convex configuration, thereby increasing the enclosure space; or (ii) from the convex configuration to the concave configuration, thereby decreasing the enclosure space.

17. An apparatus configured to operatively couple with a shower curtain for adjusting an enclosure space defined by the shower curtain, the apparatus comprising:

an adjustable portion configured to be in a standard configuration when un-inflated and to be in either a concave configuration or a convex configuration when inflated, wherein the adjustable portion has a substantially planar profile in the standard configuration, wherein the adjustable portion comprises:

a first diagonal rib disposed substantially along a first diagonal of the adjustable portion, wherein the first diagonal rib is configured to be inflated to achieve rigidity thereby biasing the adjustable portion to remain in either the concave configuration or the convex configuration and to retain sufficient flexibility to enable the adjustable portion to change from the concave configuration to the convex configuration and from the convex configuration to the concave configuration, wherein the adjustable portion is configured to receive force from a user, thereby causing the shower curtain to change:

(i) from the concave configuration to the convex configuration, thereby increasing the enclosure space; or (ii) from the convex configuration to the concave configuration, thereby decreasing the enclosure space.

18. The apparatus of claim 17, wherein the adjustable portion further comprises:

a second diagonal rib disposed substantially along a second diagonal of the adjustable portion, wherein the second diagonal rib is configured to be inflated to achieve rigidity thereby biasing the adjustable portion to remain in either the concave configuration or the convex configuration and to retain sufficient flexibility to enable the adjustable portion to change from the concave configuration to the convex configuration and from the convex configuration to the concave configuration.

19. The apparatus of claim 17, wherein the adjustable portion further comprises:

a second rib disposed substantially parallel to a width of the adjustable portion, wherein the second rib is configured to be inflated to achieve rigidity thereby biasing the adjustable portion to remain in either the concave configuration or the convex configuration and to retain sufficient flexibility to enable the adjustable portion to change from the concave configuration to the convex configuration and from the convex configuration to the concave configuration.

20. The apparatus of claim 17, further comprising:

a handle integrally attached to the adjustable portion, wherein the handle is configured to receive force from the user, thereby causing the apparatus to change:

(i) from the concave configuration to the convex configuration, thereby increasing the enclosure space; or (ii) from the convex configuration to the concave configuration, thereby decreasing the enclosure space.

* * * * *